US005473901A

United States Patent [19]

Roseen

[11] Patent Number: 5,473,901

[45] Date of Patent: Dec. 12, 1995

[54] INSULATION FOR REFRIGERATORS AND FREEZERS

[75] Inventor: Rutger A. Roseen, Lidingö , Sweden

[73] Assignee: Electrolux Research & Innovation Aktiebolag, Stockholm, Sweden

[21] Appl. No.: 115,213

[22] Filed: Aug. 31, 1993

[30] Foreign Application Priority Data

Sep. 10, 1992 [SE] Sweden ..... 9202609

[51] Int. Cl.[6] ..... F17C 3/00; F25B 19/00; B32B 5/20

[52] U.S. Cl. ..... 62/DIG. 13; 62/45.1; 62/268; 264/102; 264/138

[58] Field of Search ..... 417/44; 62/45.1, 62/268, DIG. 13; 264/46.5, 102, 138; 312/409; 428/69

[56] References Cited

U.S. PATENT DOCUMENTS

| | | | |
|---|---|---|---|
| 975,265 | 11/1964 | Griffiths | 62/DIG. 13 |
| 2,000,882 | 5/1935 | Comstock | 62/268 |
| 4,027,379 | 6/1977 | Cheng et al. | 62/DIG. 13 |
| 4,349,051 | 9/1982 | Schilf | 138/149 |
| 4,438,166 | 3/1984 | Gluck et al. | 428/113 |
| 4,448,041 | 5/1984 | Southworth, Jr. | 62/268 |
| 4,668,555 | 5/1987 | Uekado et al. | 428/69 |
| 4,821,399 | 4/1989 | Markley et al. | 29/458 |
| 4,972,003 | 11/1990 | Grunbauer et al. | 521/131 |
| 4,997,786 | 3/1991 | Smits et al. | 428/314.4 |
| 5,066,437 | 11/1991 | Barito et al. | 264/46.5 |
| 5,082,335 | 1/1992 | Cur et al. | 312/401 |
| 5,093,377 | 3/1992 | Bartlett et al. | 521/114 |
| 5,109,032 | 4/1992 | Uekado et al. | 521/110 |
| 5,304,339 | 4/1994 | Le Comte | 264/102 |
| 5,316,816 | 5/1994 | Sextl et al. | 264/102 |

*Primary Examiner*—Richard A. Bertsch
*Assistant Examiner*—Xuan M. Thai
*Attorney, Agent, or Firm*—Pearne, Gordon, McCoy & Granger

[57] ABSTRACT

Heat insulation is provided for a refrigerator or freezer. The insulation includes a closed cell material, which is placed in a hermetically closed space (13) surrounded by a diffusion-tight shell. The space communicates with a vacuum source, and a gas diffuses through the cells five times faster than air gasses. The material does not achieve its full insulating properties until the refrigerator has been used.

11 Claims, 1 Drawing Sheet

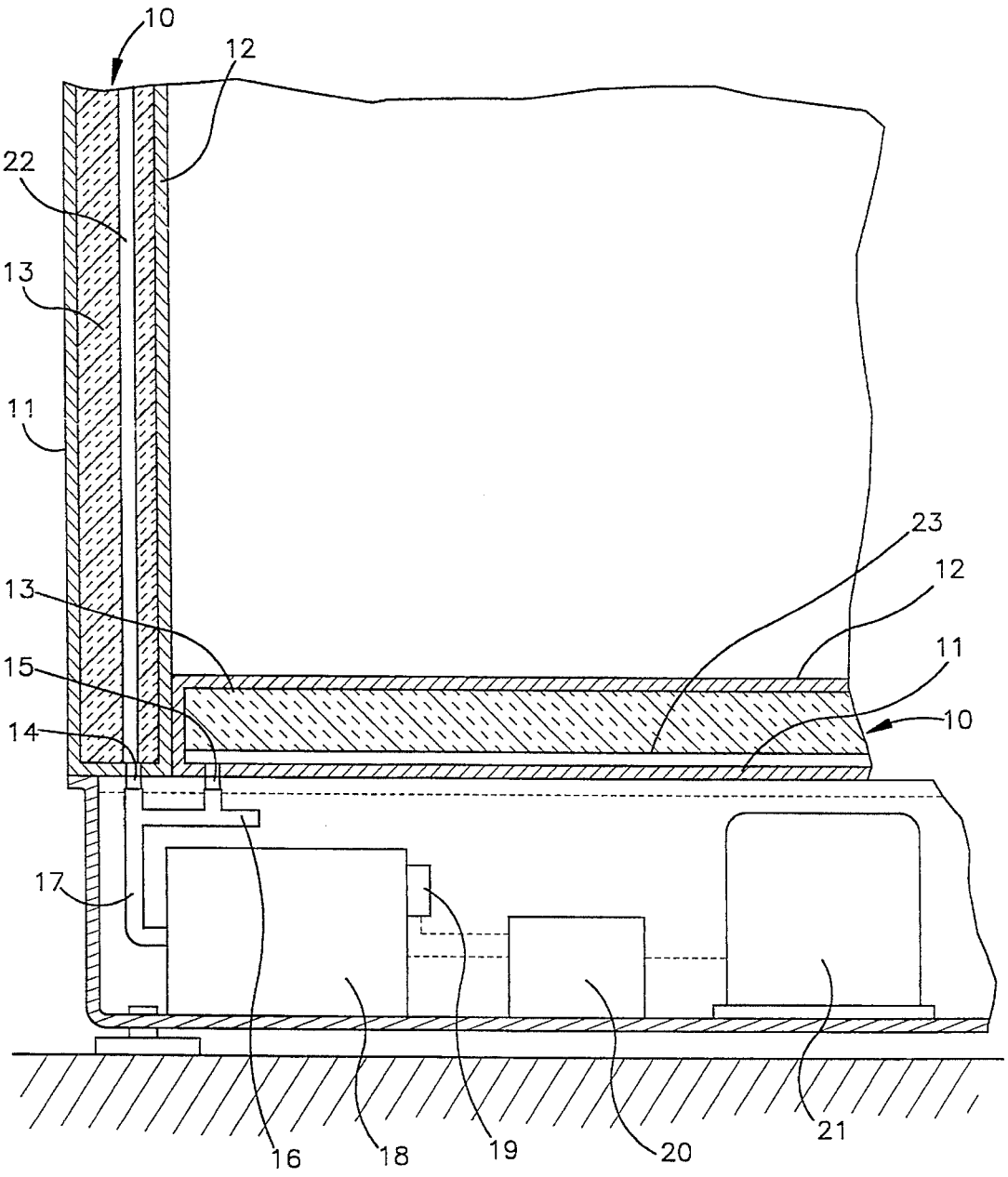
10
12
22
13
11
23
12
13
11
15
10
14
17
16
18
19
20
21

INSULATION FOR REFRIGERATORS AND FREEZERS

BACKGROUND OF THE INVENTION

1. Field of the Invention

This invention relates to insulation for refrigerators and freezers.

2. Description of the Related Art

Previously, several different materials and material combinations have been suggested in order to increase the heat insulation characteristics for walls and doors in refrigerators and freezers. It has also been suggested to use so called "vacuum panels". Conventional insulations usually comprise foamed polymeric materials, whereas for vacuum panels, an evacuated shell of diffusion-tight material, for instance plastic or sheet metal, which is filled with powder or cellular material is used. This last-mentioned arrangement is described for instance in SE 90937, EP 188806, JP 63135694, U.S. Pat. No. 5,066,437. The arrangement has, however, certain drawbacks since it is difficult to maintain sufficiently low pressure during the complete lifetime of the cabinet, which is 15–20 years, since minor leakage decreases the heat insulation characteristics. Further, it is difficult and expensive to carry on the evacuation process to a desirable extent in mass production since such an evacuation process takes a very long time. Because of the long and narrow evacuation passages, it takes at least 15 hours to reduce the pressure to 1 mbar independently of the capacity of the vacuum pump, whereas the production time for a refrigerator is about 20 minutes.

In order to make it possible to evacuate slightly faster, as appears from some of the above-mentioned publications, polymeric materials with open cell structure have been used. The disadvantage with an open cells structure, both with regard to conventional insulations and vacuum insulations, is, however, that with such a structure, it is difficult to fulfill the demands for mechanical strength at lower densities. In practice, it has been necessary to use comparatively high densities which means that the price, weight, and heat conductivity in the solid state increase considerably.

A closed cell structure in combination with adherence to the surrounding shell gives mechanical stability also at comparatively low densities, but requires small cells in order to minimize the heat transportation by radiation and in order to get superinsulation (which means that the free length of movement of the molecules should be of the same magnitude as the size of the cell) at as high pressure as possible.

The above-mentioned desires regarding closed and open cells are thus contradictory which means that the properties which have been regarded as most important, i.e. mechanical strength or the possibility to evacuate the insulation quickly, have determined what kind of cell structure that should be used.

It is also known, see U.S. Pat. No. 4448041, to use vacuum insulated wall elements for large mobile cold storage rooms, the wall elements communicating with a vacuum pump. These vacuum pumps are, however, of conventional type and hence comparatively power demanding and expensive. Their use can, with regard to costs and energy consumption, only be suggested for the type of large construction which is described in the above-mentioned publications.

Further FR 2628179 describes hermetically sealed wall elements which, in a manner not shown in detail, are connected to some kind of vacuum source, the 50–100 mbar pressure which is created is comparatively high and, being in such an interval, cannot in any higher degree contribute to increase the heat insulation capability.

SUMMARY OF THE INVENTION

The purpose of this invention is to achieve an arrangement by means of which it should be possible to create a permanent vacuum insulation with very good heat insulating characteristics for refrigerators and freezers in modern mass production and which, in principle, reduces the energy consumption by 50% compared to refrigerators and freezers of today. The arrangement does not have the drawbacks which are described above with reference to the vacuum panels described. The basis of the invention is that the cabinet, during production, is equipped with an inexpensive and energy saving vacuum pump which communicates with hermetically sealed spaces in the walls and/or doors of the cabinet. Such a pump is described in U.S. patent application Ser. No. 5,358,389, filed on even date herewith. U.S. patent application Ser. No. 5,361,598, filed on even date herewith, shows another related structure. These spaces are provided with a heat insulating material with particular properties, these properties appearing from the characteristics described below and in the claims.

BRIEF DESCRIPTION OF THE DRAWINGS

An embodiment of the invention will now be described in detail with reference to the accompanying drawing in which the figure schematically shows a section through a refrigerator or freezer cabinet with insulation according to the invention.

BRIEF DESCRIPTION OF THE PREFERRED EMBODIMENT

In the figure, several wall parts 10 or walls defining doors which surround a cold room are shown. The wall parts have an outer and inner shell 11 and 12, respectively, which are joined to each other and which form a hermetically sealed space 13 therebetween which is filled with heat insulating material. This material at least partly consists of closed cells which are produced by foaming, for instance polyol/isocyanate, with a gas having such properties that it can diffuse through the cell structure with a velocity which is at least five times faster than air gasses. A suitable gas is, for instance, carbon dioxide. By foaming with small molecules, such as carbon dioxide, a closed cell structure can achieve such a high diffusion velocity that the evacuation can be accomplished during a reasonable time period, such a period in this context being between 24-hours and several months. The evacuation process is taken to a great extent which means that a final pressure which is less than 0.1 mbar is maintained in an evacuation conduit 17, this level being achieved in the insulation after a long time use of a cabinet. Each space 13, via an evacuation channel 14, 15, 16, communicates with the evacuation conduit 17 which is connected to a vacuum pump 18.

The vacuum pump is driven by an electric motor having a very low power consumption. The pressure in the evacuation conduit 17 is sensed by a sensor 19 which is connected to an electric control means 20 deactivating the pump when a certain underatmospheric pressure has been achieved in the evacuation conduit. The control means 20 can also be used to activate or deactivate, that is, control, the compressor 21 in the cabinet with a thermostat.

In the material which is provided in the space 13, it is possible to make distribution channels 22 which connect remote parts of the insulation with the evacuation channels 14, 15, 16. The distribution channels are produced by means of thermal pipes, by chemical shock, for instance by putting a thin, unisolated conduit in the material, after which a current is allowed to flow through the conduit so that the heat burns a channel, or by using focused light for the same purpose. It is also possible to create distribution channels by putting a fiber material 23 in the insulation, preferably on its outside. Also by a suitable choice of material, a spontaneous cracking of the cells can be achieved during the evacuation because of the pressure difference between the outside and inside of the cell.

It should be mentioned that it is possible to place insulating material in any diffusion-tight material, for instance plastic. The diffusion-tight material forms a surrounding cover which, after evacuation is placed in the shell which forms the walls of the refrigerator or freezer. This creates mechanical stability and also a slot between the shell and the insulating material the slot being used for the evacuation.

Although the preferred embodiments of this invention have been shown and described, it should be understood that various modifications and rearrangements of the parts may be resorted to without departing from the scope of the invention as disclosed and claimed herein.

What is claimed is:

1. Heat insulation for refrigerator or freezer comprising a material placed in a hermetically sealed space (13) and surrounded by a diffusion-tight shell, characterized in that the material in the space (13) communicates with a vacuum source (18), and the material comprises closed cells with a gas which can diffuse through the cell structure with a velocity which is at least five times faster than air gasses whereby said insulation does not achieve its full insulating properties until the refrigerator has been used.

2. Insulation according to claim 1 characterized in that the material consists of a foamed material, said gas being a drive gas in the foaming procedure.

3. Insulation according to claim 1 characterized in that said gas is carbon dioxide.

4. Insulation according to claim 1 characterized in that the insulation comprises distribution channels (22, 23) for forming transport conduits for the gas in the insulation.

5. Insulation according to claim 4 characterized in that a fiber material forms the distribution channels (23).

6. Insulation according to claim 4 characterized in that the distribution channels (22) are created by means of thermal shock.

7. Insulation according to claim 4 characterized in that the channels are formed along the border between the material and the shell by not allowing the material to adhere to the shell.

8. Insulation according to claim 1 characterized in that the shell is a plastic material.

9. Insulation according to claim 5, characterized in that the fiber material is in contact with the shell.

10. Insulation according to claim 6, characterized in that the thermal shock is created by a heated electric conduit.

11. Insulation according to claim 6, characterized in that the thermal shock is created by focused light.

* * * * *